United States Patent [19]

Ekins

[11] Patent Number: 4,706,675

[45] Date of Patent: Nov. 17, 1987

[54] SUPPORT GARMENT FOR ENERGETIC ACTIVITIES

[75] Inventor: David L. Ekins, Calabasas, Calif.

[73] Assignee: The Gold Belt Line, Inc., Reseda, Calif.

[21] Appl. No.: 845,643

[22] Filed: Mar. 28, 1986

[51] Int. Cl.[4] ..... A41C 1/00
[52] U.S. Cl. ..... 450/114
[58] Field of Search ..... 128/538, 534, 519

[56] References Cited

U.S. PATENT DOCUMENTS

| | | | |
|---|---|---|---|
| 1,463,553 | 7/1923 | Lasater | 128/534 |
| 2,481,396 | 9/1949 | Cohen | 128/519 |
| 3,185,158 | 5/1965 | Guttuso | 128/519 |
| 3,457,926 | 7/1969 | Bacon et al. | 128/519 |

*Primary Examiner*—Doris L. Troutman
*Attorney, Agent, or Firm*—Donald D. Mon

[57] ABSTRACT

The invention is a garment to support and to clothe portions of the body during energetic activities such as motorcross riding. The support function is commonly referred to as a kidney belt that includes a riding brace element and a pair of flexible straps attached to and extending from the brace element.

4 Claims, 2 Drawing Figures

SUPPORT GARMENT FOR ENERGETIC ACTIVITIES

FIELD OF THE INVENTION

This invention relates to support garments for energetic activities, for example motocross riding.

BACKGROUND OF THE INVENTION

Support garments are generally worn in energetic activities where the activity includes substantial vibration and impact. Motorcycle riding, and motocross activities in particular, strongly shake the rider. His internal organs, especially the kidneys, are prey to these forces. Over a span of time, considerable irreversible damage can be done unless care is taken to prevent it. Of course, smoothing out the ride is one way to accomplish this objective, but this would eliminate almost all off-road operations, and preclude the use of many of the most powerful, lightweight machines.

The solution, to the extent there is one, lies in the direction of protective and supportive garments which embrace the body and by doing so reduce the extent of violent internal movements of the internal organs. Support belts, sometimes called kidney belts, are known for this purpose. They elastically embrace the abdomen, and bring to bear against the back a stiffened, sometimes ribbed, structure that both anchors the elastic belt and itself compressively supports the rear lumbar area, to the benefit of the internal organs.

However, cyclists do not ride around only in their protective belts. Beyond modesty, there is need to protect them from flying objects such as rocks and debris, from mud, water, cold air, and even flame. Protective trousers are common for this purpose. Reduced to absurdity in the other extreme is a rider clothed in a large number of protective items. The reason this is absurd is that as he moves vigorously, the parts of clothing move relative to one another, and reorganizing it soon becomes both a task and a concern. The rider can readily do without this distraction and discomfort.

It is an object of this invention to provide a support garment which incorporates back and abdominal support, and also the trousers. The trousers, which are the garment likeliest to be displaced by vigorous movement, are held in place by the support belt, but the trousers do not impede or duplicate the function of the support belt.

BRIEF DESCRIPTION OF THE INVENTION

A support garment according to this invention comprises a support belt having a relatively stiff back member to cover a substantial area of the lower part of the back and pair of joinable straps that embrace the abdomen. A pair of trousers has a waistband to encircle the waist of the wearer, and its rearward portion is unitary with the back portion of the support belt. The joinable straps are not joined to the waistband. The primary support for the trousers is the support belt, and this support is exerted at the back. Thus, except at the back, the waistband of the trousers and the abdominal support are not connected, but they do overlap. As a consequence the trousers are stabilized relative to the support belt, but the stiff back member independently and without interference from the front and sides of the trousers, gives support to the small of the back, both above and below the waistline, and still does anchor the trousers against slipping off.

The above and other features of this invention will be understood from the following detailed description and the accompanying drawings, in which:

DETAILED DESCRIPTION OF THE INVENTION

Figure 1:
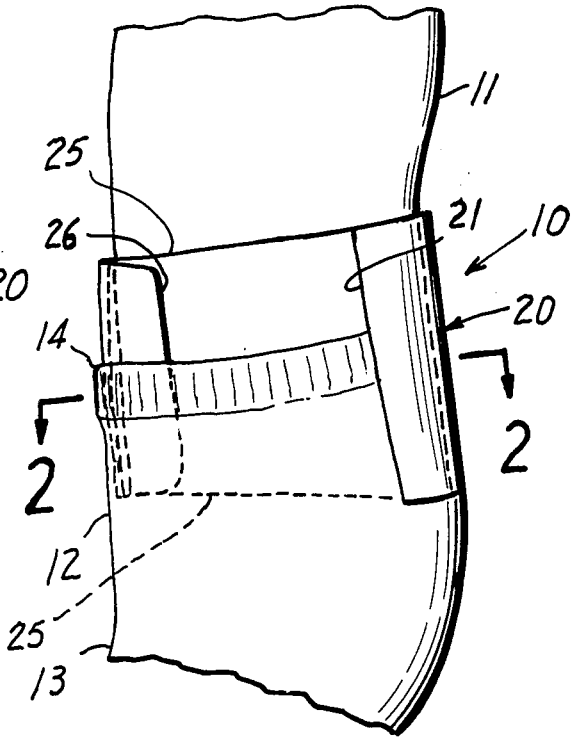
FIG. 1 is a side view of the presently—preferred embodiment of the invention.
Figure 2:
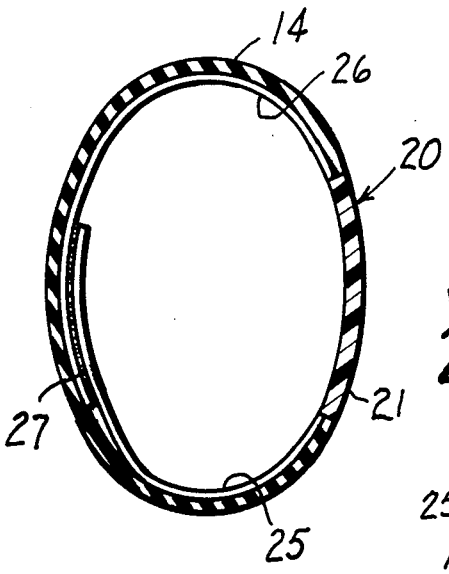
FIG. 2 is a section taken at line 2—2 in FIG. 1.

A garment 10 according to the invention is shown in FIG. 1, on the torso 11 of a wearer. It is a typical trouser or shorts garment with an upper portion 12 and a pair of leg portions 13. It has a waistband 14, preferably elastic, although it could be a flexible inelastic belt if preferred, which encircles the waist of the wearer. The waistband is integral with the trousers, being stitched to the upper portion around the full periphery, except perhaps at the very back where it forms a common structure with a support belt 20.

Support belt 20 includes a stiffly flexible member 21 of substantial area intended to be brought against and support a substantial portion of the lumbar region of the back. The trouser waistband is stitched or otherwise attached to member 21. It can of course extend across member 21, but is may be preferred to attach the waistband to the edges of member 21 as shown. Whatever the situation, the support belt and trousers are joined together at the back.

This support belt includes a pair of straps 25, 26 which have a substantial width, and are at least in part elastic. Hook and eyelet fastener means 27 such as Velcro is attached to these straps, so the straps can be drawn tight across the abdomen and pressed against one another to hold the support belt in place. The straps are also attached such as by stitching to element 21, but they are not attached to the waistband. At least one of the straps has an elastic portion. Preferably both are entirely made of flexible elastic material.

The waistband of the trousers encircles the support belt. The two straps are joined inside the waistband.

Thus, when the trousers are pulled up, the straps are brought into position to stabilize the support belt. The support belt now anchors the trousers, and the rider has the benefit of physical support plus stability of clothing without requiring additional elements such as buckles, pins, straps, or the like.

This invention is not to be limited by the embodiment shown in the drawings and described in the description, which is given by way of example and not of limition, but only in accordance with the scope of the appended claims.

I claim:

1. A garment to support and to cover portions of the body during energetic activities, said garment comprising:

a support for the back of the wearer, comprising a central, relatively rigid brace element so proportioned and shaped as to bear against and brace the lower region of the wearer's back, extending both above and below the wearer's waistline, and extending for a substantial length laterally from both sides of the wearer's spine, a pair of flexible straps attached to and extending laterally from said brace element, at least one of said straps being at least in part elastic, and joinder means to join said straps together when wrapped around the wearer's torso with said brace element bearing against the wearer's back;

a clothing element having an upper portion, a pair of leg portions, and a waistband, said waistband at least partially encircling the waist of said wearer, being attached to said brace element, and with its encircling portion free from and outside of said straps, no portion of said clothing element extending above said waistband, said straps extending both above and below said waistband;

whereby said brace element may be tightened in place independently of said waistband, and said clothing element is held against sliding off by virtue of its attachment to said brace element.

2. A garment according to claim 1 in which said waistband is attached to the brace element at the edges thereof, said brace element thereby forming a continuation of the waistband.

3. A garment according to claim 1 in which said waistband is at least in part elastic.

4. A garment according to claim 1 in which said joinder means comprises hook and eyelet material.

* * * * *